US008261728B1

(12) United States Patent
Tseng

(10) Patent No.: US 8,261,728 B1
(45) Date of Patent: Sep. 11, 2012

(54) FIRING MECHANISM FOR A PAINT BALL GUN

(76) Inventor: Ying-Jung Tseng, New Taipei (TW)

( * ) Notice: Subject to any disclaimer, the term of this patent is extended or adjusted under 35 U.S.C. 154(b) by 0 days.

(21) Appl. No.: 13/211,338

(22) Filed: Aug. 17, 2011

(51) Int. Cl.
*F41B 11/00* (2006.01)

(52) U.S. Cl. ..... 124/73

(58) Field of Classification Search ..... 124/73
See application file for complete search history.

(56) References Cited

U.S. PATENT DOCUMENTS 6,343,599 B1 * 2/2002 Perrone ..... 124/73
6,502,568 B2 * 1/2003 Kunimoto ..... 124/73
6,637,420 B2 * 10/2003 Moritz ..... 124/73
7,967,000 B2 * 6/2011 Walker et al. ..... 124/73
2004/0089280 A1 * 5/2004 Kunimoto ..... 124/76
2006/0107939 A1 * 5/2006 Dobbins ..... 124/73
2007/0017497 A1 * 1/2007 Masse ..... 124/73
2009/0260610 A1 * 10/2009 Walker et al. ..... 124/73
2010/0282324 A1 * 11/2010 Page et al. ..... 137/1
2011/0120437 A1 * 5/2011 Tippmann et al. ..... 124/74
2011/0186026 A1 * 8/2011 Tippmann et al. ..... 124/73
2012/0031386 A1 * 2/2012 Masse ..... 124/73
2012/0048253 A1 * 3/2012 Hu ..... 124/73

* cited by examiner

*Primary Examiner* — Michelle Clement

(57) ABSTRACT

A firing mechanism for a paint ball gun is provided so that wherein in response to turning off a switch and pressing a trigger an inner sliding assembly moves rearward to move a first piston, a second piston, and a plunger rearward until being stopped and disable both a safety and an arc member, and a blocked flow path is open to supply compressed gas from a pressure vessel to a passage member for pushing a topmost pellet through a barrel.

1 Claim, 11 Drawing Sheets

FIRING MECHANISM FOR A PAINT BALL GUN

BACKGROUND OF THE INVENTION

1. Field of the Invention

The invention relates to paint ball guns and more particularly to a firing mechanism for a paint ball gun.

2. Description of Related Art

A paint ball gun is the main piece of equipment in the sport of paint ball. Guns use an expanding gas, such as compressed air or carbon dioxide ($CO_2$) to propel paint balls through the barrel. Paint ball guns can fire in rapid succession a relatively large number of paint balls in a short period of time. A magazine stores the paint balls until the balls are delivered to the gun firing chamber. The guns use compressed gas as the propellant, and are usually triggered by a user squeezing a conventionally shaped gun trigger. When the gun user repeatedly squeezes the trigger, the gun should continue to fire paint balls as rapidly as possible. Guns may be manually loaded before each shot, but most are either semi-automatic, where each time the trigger is pulled a paint ball is fired, or fully automatic, where the balls are fired as quickly as the gun is capable of for as long as the trigger is pulled.

During a firing sequence, paint balls on occasion lodge against each other or other objects and block the passageway to the firing chamber, resulting in a jam. While jamming is not new, knowledge from explosive munitions magazines is of little use with the very different paint balls.

Thus, the need for minimizing jams and the provision of other improvements still exist.

SUMMARY OF THE INVENTION

It is therefore one object of the invention to provide a device for controlling the firing of a paint ball gun comprising a pressure vessel with compressed gas stored therein; a magazine for storing a plurality of pellets and disposed forward of the pressure vessel; a trigger disposed forward of the magazine; a plate member disposed rearward of the trigger and activated by pulling the trigger; a pivotal member disposed at a bottom of the bolt housing and pivotably secured to the plate member; a bifurcation member for receipt of the pivotal member; a retaining member disposed in the bifurcation member; a rocking member for retaining the pivotal member; a bolt housing comprising a passage member communicating with the pressure vessel, a tube extending forward of the passage member, a hollow enlargement at a rear end of the tube, a switch disposed to allow a topmost one of the pellets to enter the bolt housing or not, an arc member for retaining the pellet, and a safety disposed adjacent to the arc member; a spring biased outer sliding member disposed forward of the bolt housing; a barrel disposed in the outer sliding member and having a rear end in communication with the bolt housing; an inner sliding assembly comprising a spring biased first sleeve, a second sleeve secured to the first sleeve and including a projection on an outer surface, a retaining ring disposed on the first sleeve at a joining portion of the first sleeve and the second sleeve, and an inward extending rim on a rear end of the second sleeve; a plunger disposed in the second sleeve and projecting rearward out of the inward extending rim, the plunger being defined to move in the second sleeve by the inward extending rim; a first piston disposed in the passage member, the first piston being disposed in a first position to block a flow path in the passage member when the trigger is not depressed; a second piston disposed in a joining portion of the second sleeve and the passage member; a first biasing member disposed between the first piston and the second piston; a piston member disposed through the second piston and biased by the first biasing member; and a second biasing member having a forward end anchored on a rear end of the second piston and a rear end adapted to engage with the plunger; wherein in response to turning off the switch and pressing the trigger the inner sliding assembly moves rearward to move the first piston, the second piston, and the plunger rearward until being stopped and disable both the safety and the arc member, and the blocked flow path is open to supply compressed gas from the pressure vessel to the passage member for pushing the topmost pellet through the barrel.

The above and other objects, features and advantages of the invention will become apparent from the following detailed description taken with the accompanying drawings.

BRIEF DESCRIPTION OF THE DRAWINGS

FIG. 9 is a view similar to FIG. 4 showing a plunger being stopped after moving rearward and the.

DETAILED DESCRIPTION OF THE INVENTION

Figure 1:
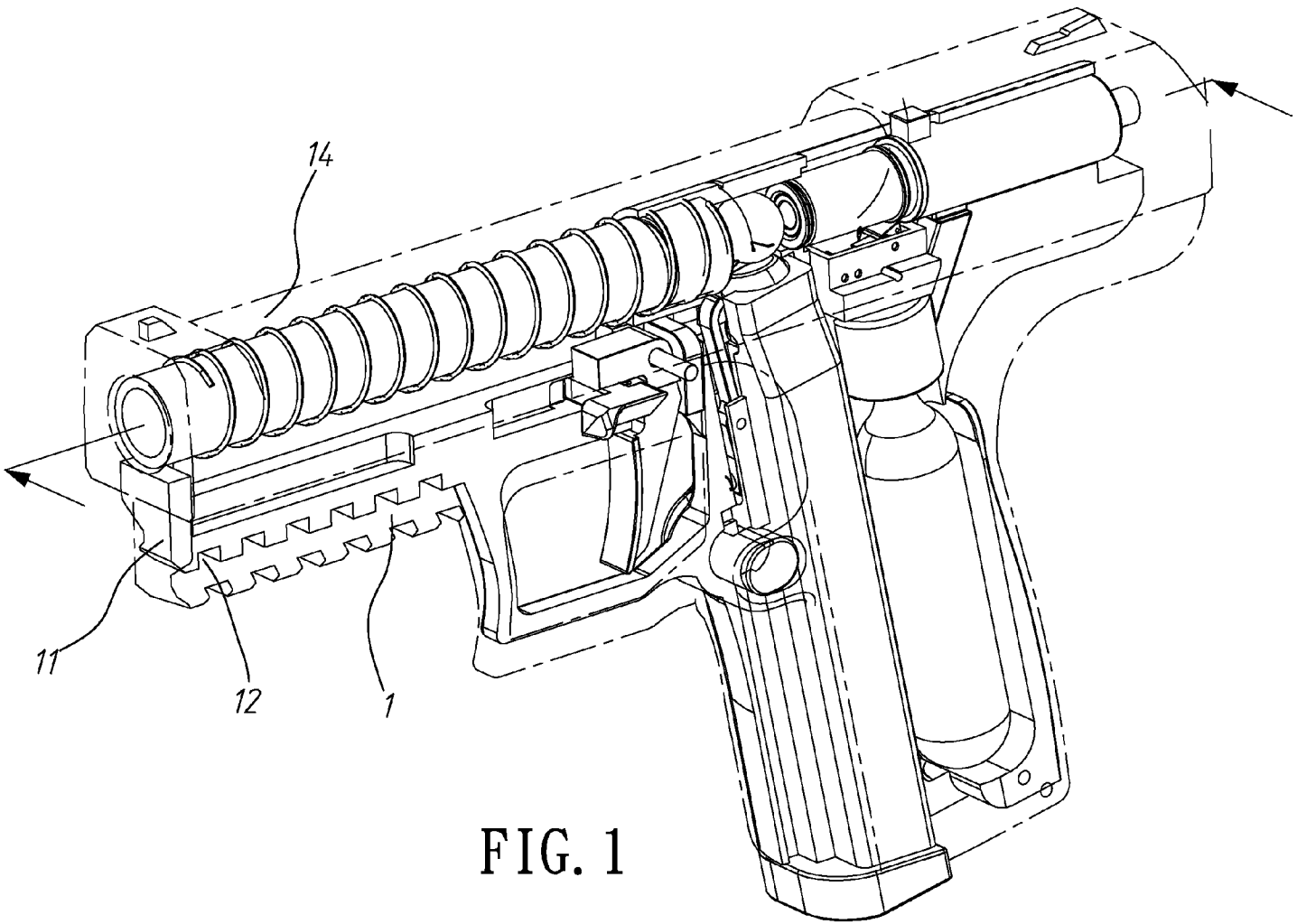
FIG. 1 is a perspective view of a paint ball gun according to the invention.
Figure 2:
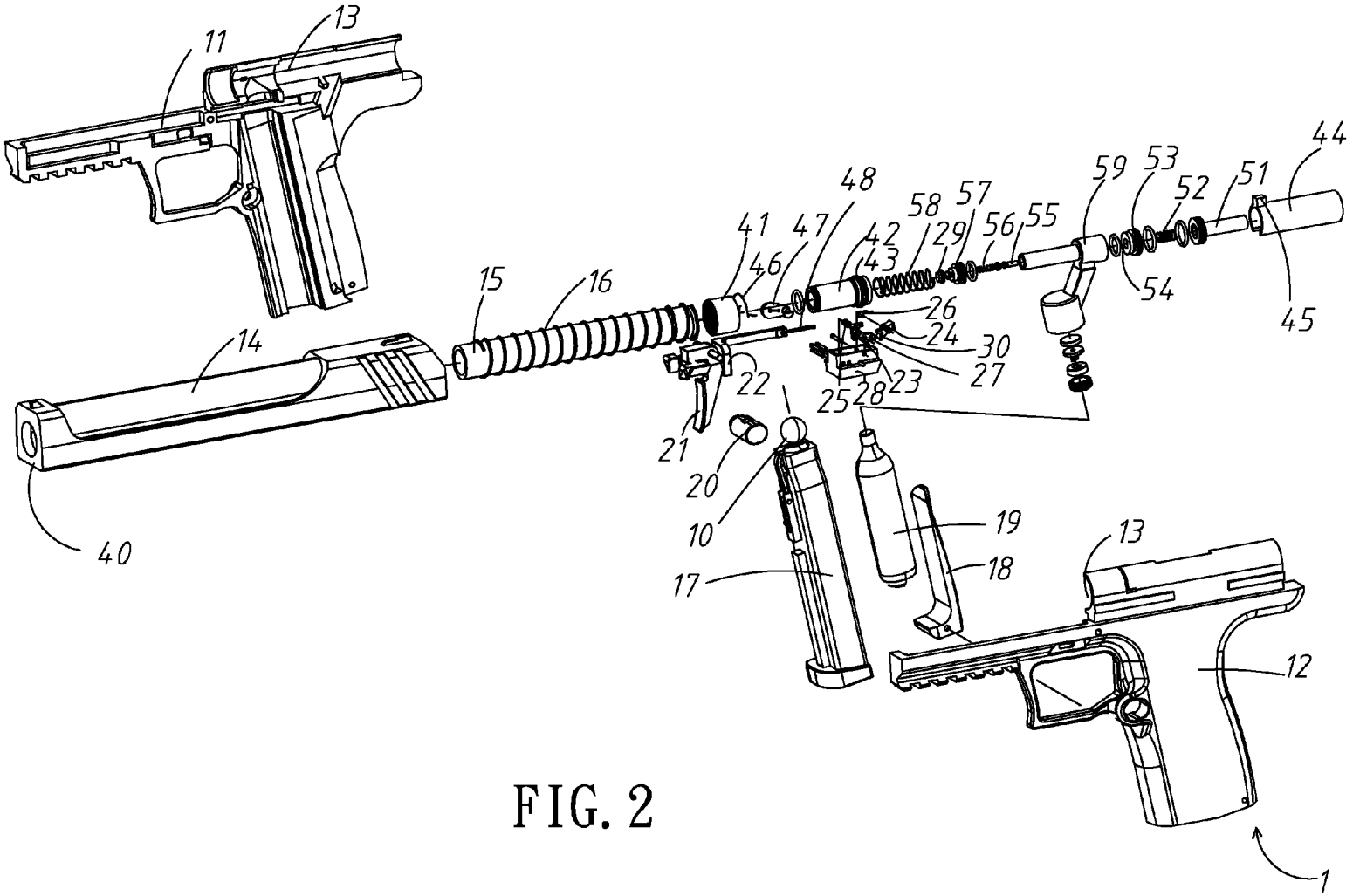
FIG. 2 is an exploded view of the paint ball gun.
Figure 3:
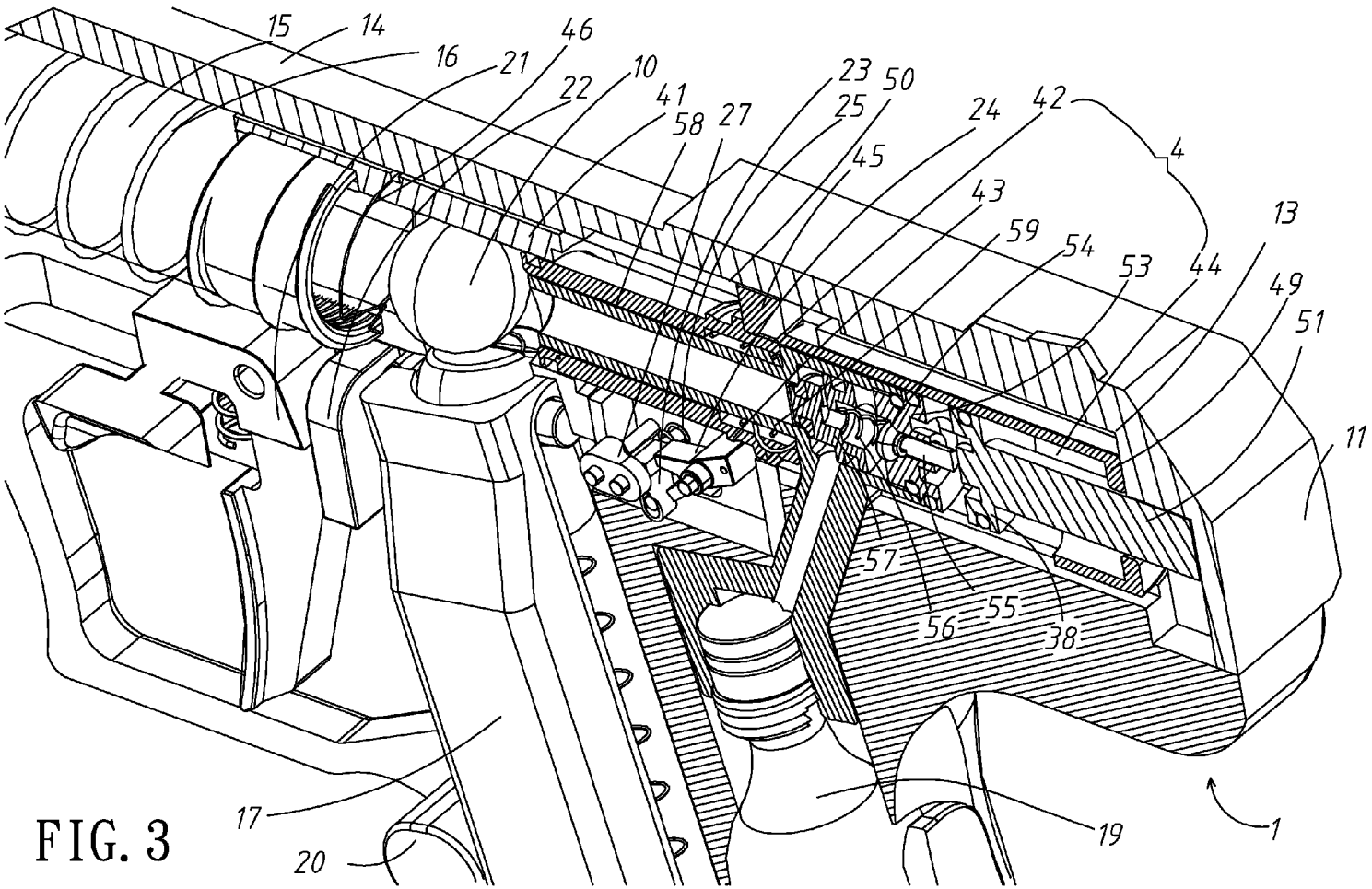
FIG. 3 is a perspective view in part section of a rear upper portion of the paint ball gun showing a firing mechanism thereof.
Figure 4:
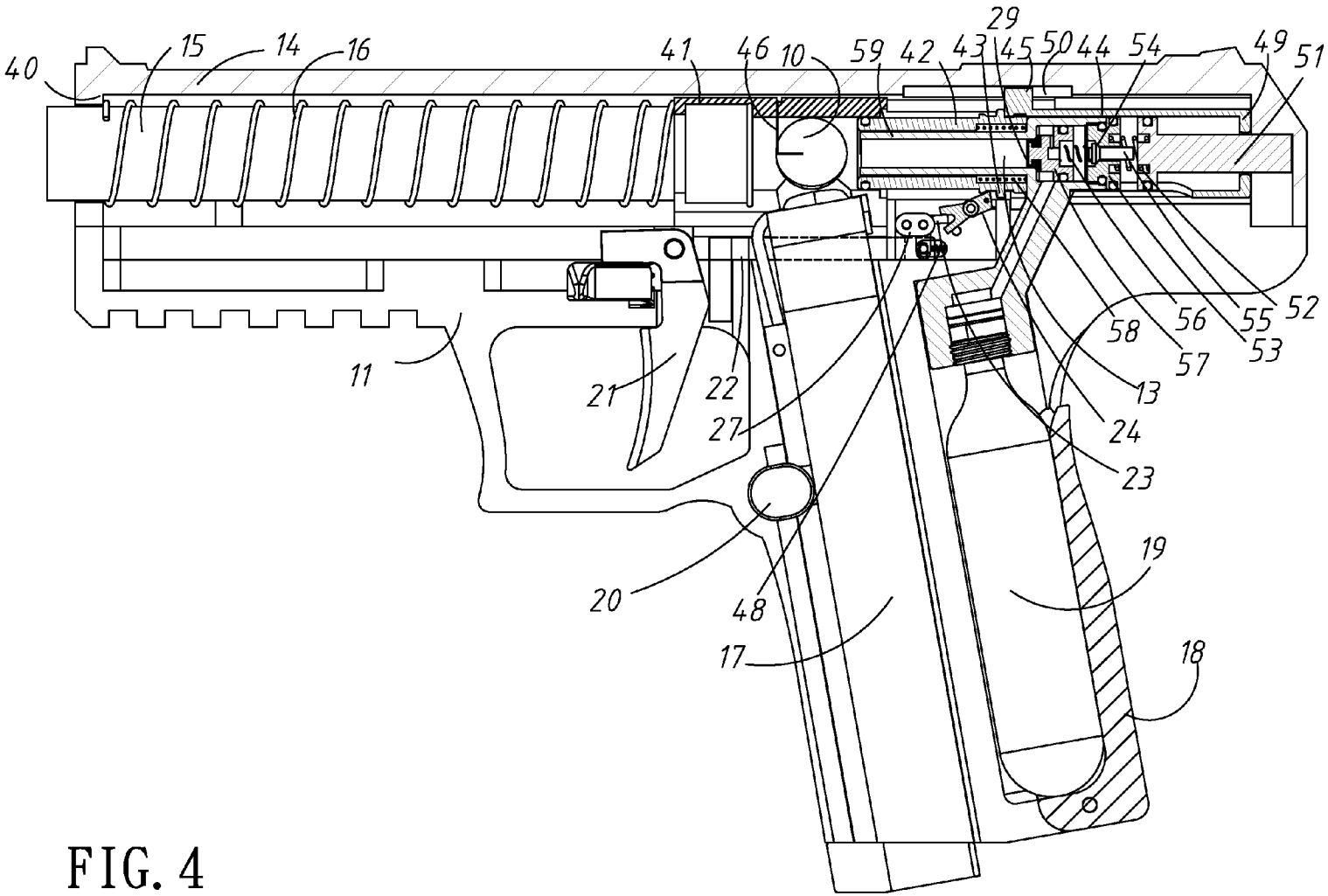
FIG. 4 is a schematic longitudinal sectional view of the paint ball gun.
Figure 5A:
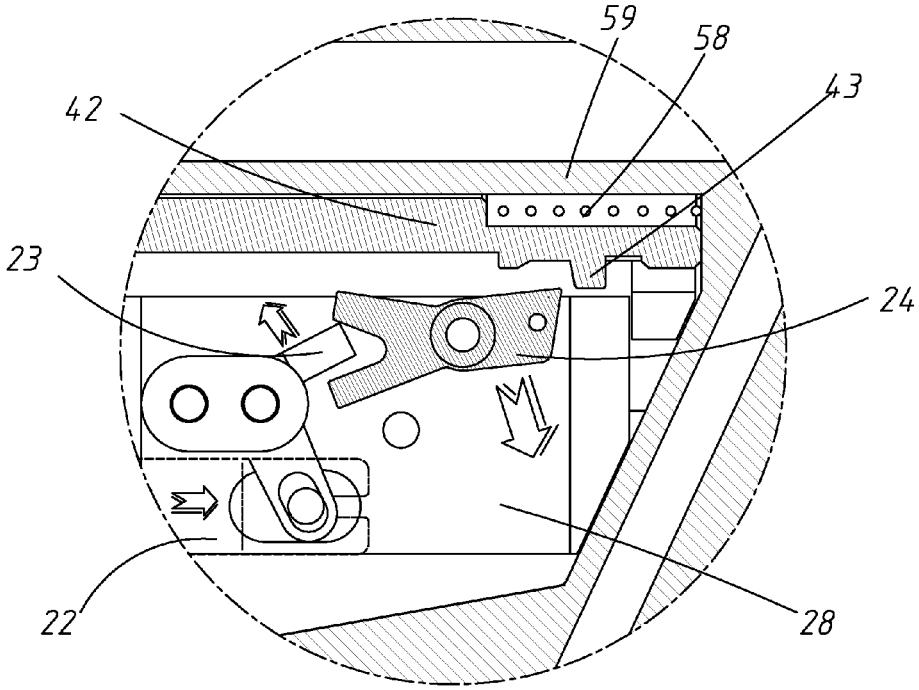
FIG. 5A is a detailed view of the area in circle A of FIG. 5.
Figure 5:
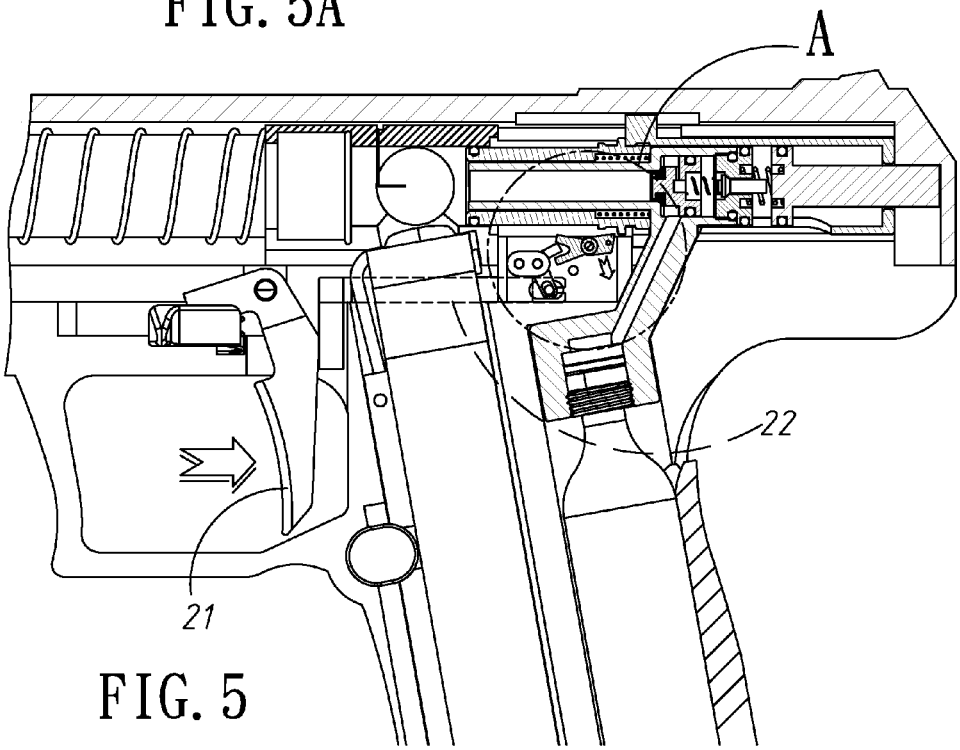
FIG. 5 is an enlarged view of the right upper portion of FIG. 4.
Figure 6:
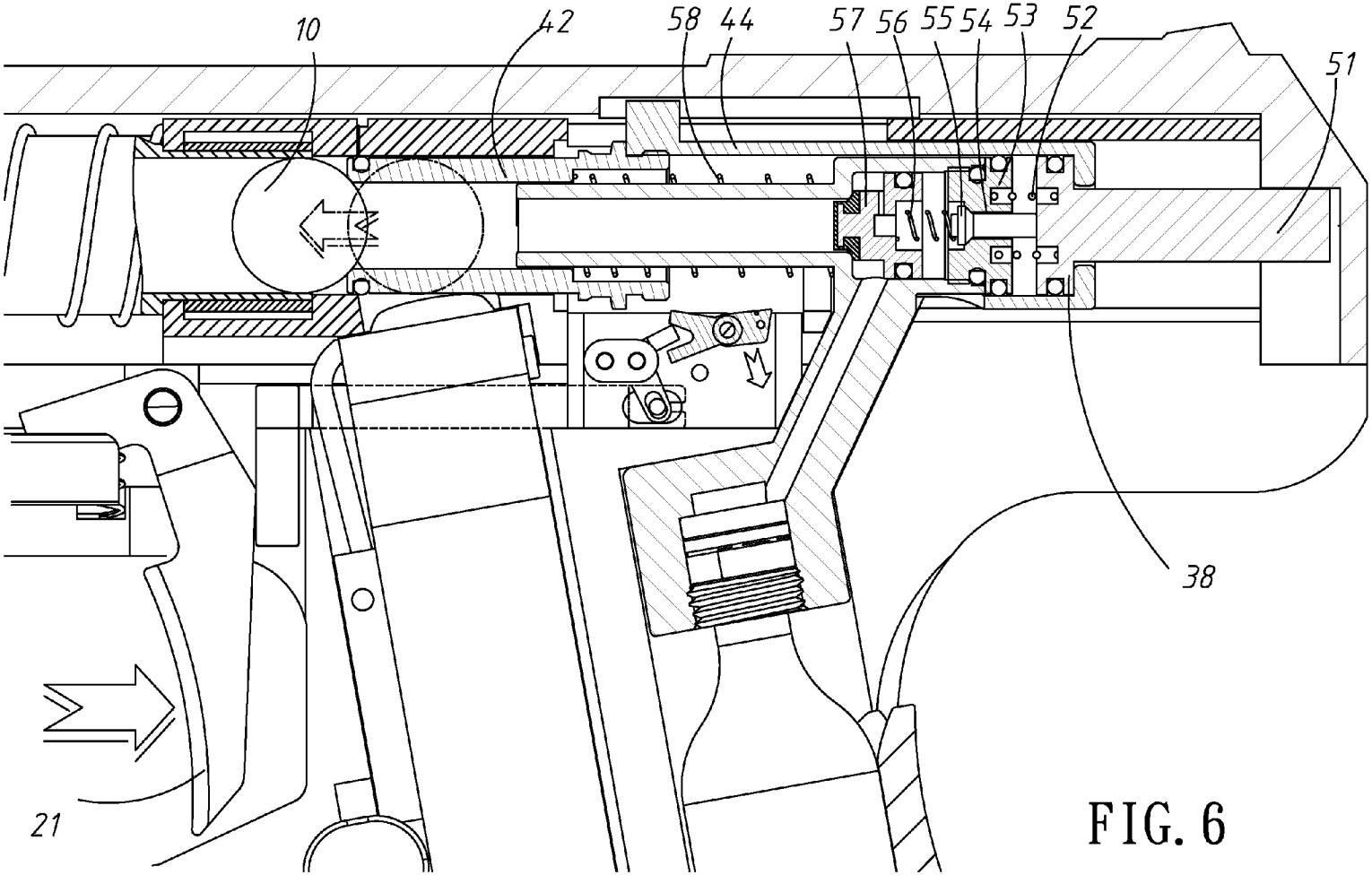
FIG. 6 is a further enlarged view of FIG. 5 showing a pellet being fired by pulling a trigger.
Figure 7:
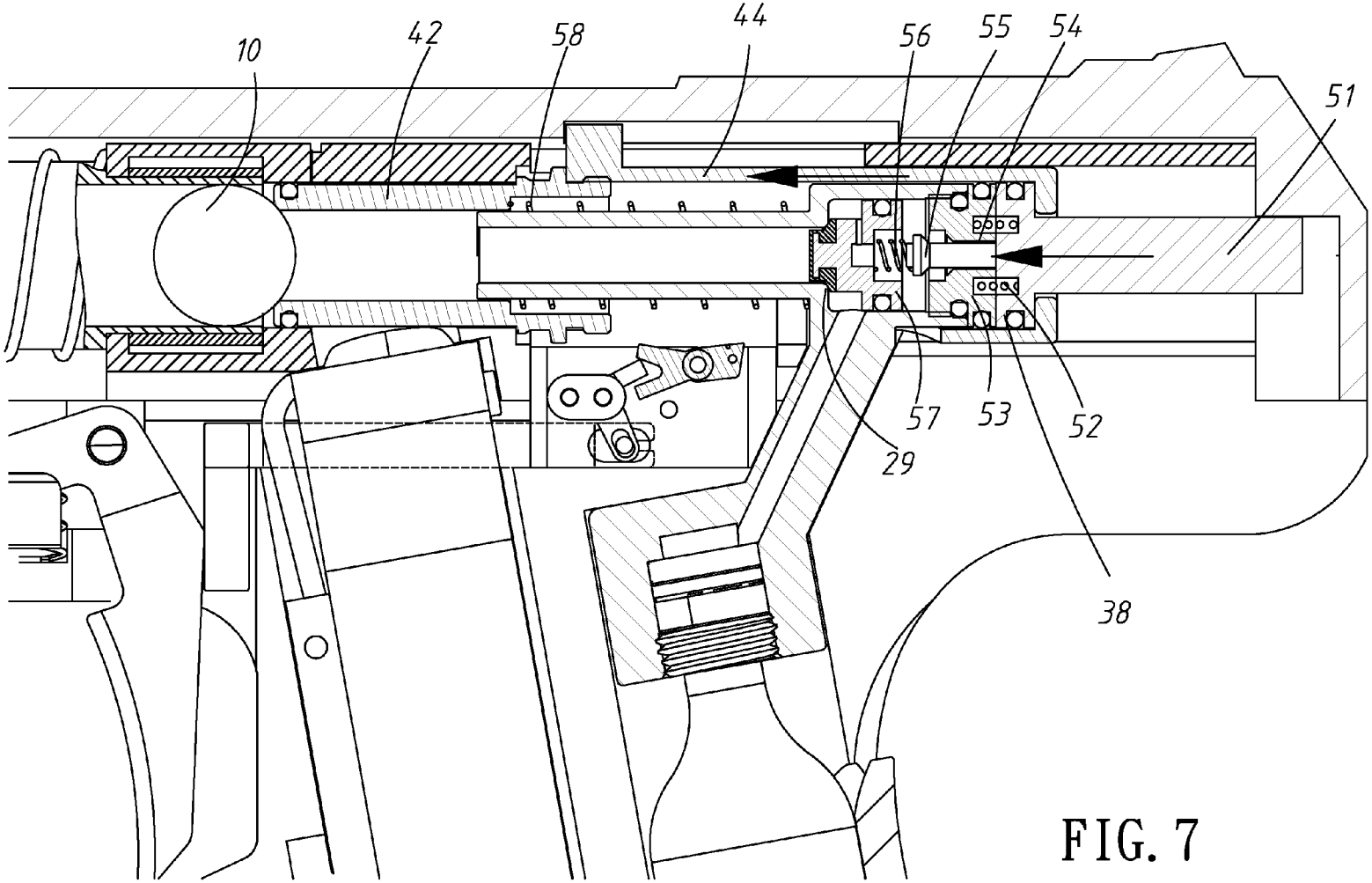
FIG. 7 is a view similar to FIG. 6 showing an inner sliding assembly moving forward.
Figure 8:
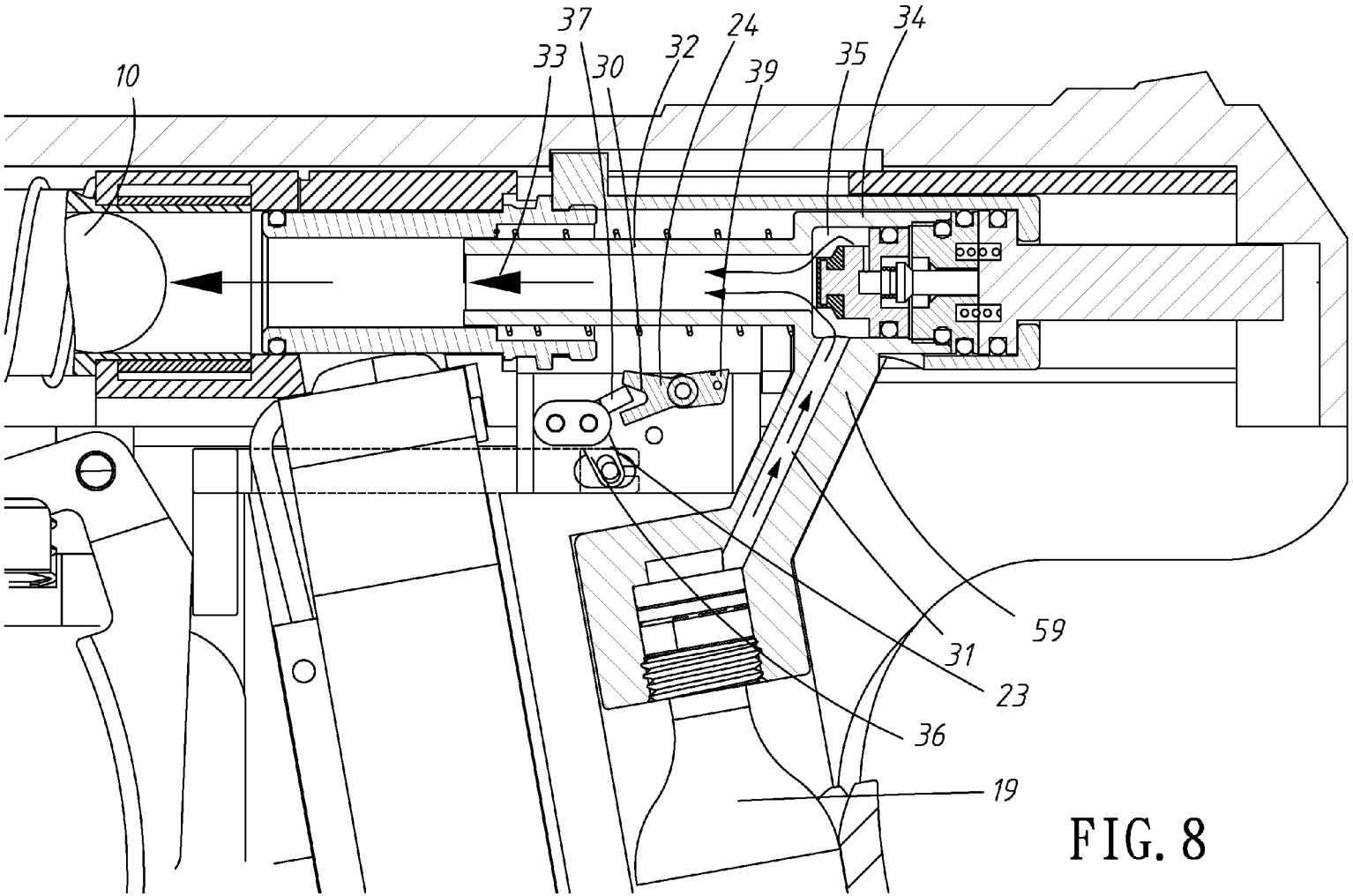
FIG. 8 is a view similar to FIG. 6 showing the pellet entering a barrel.
Figure 9:
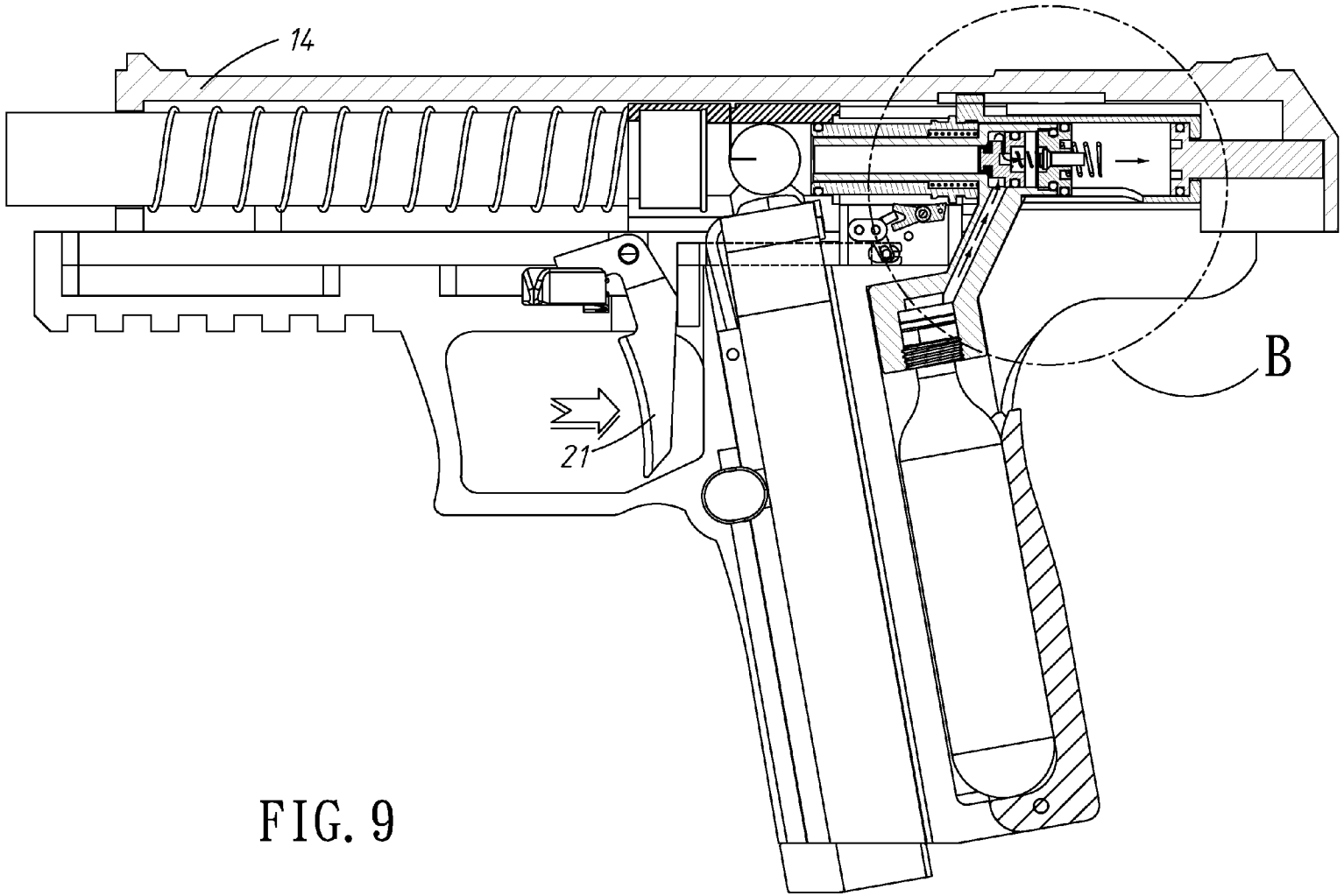
Figure 9A:
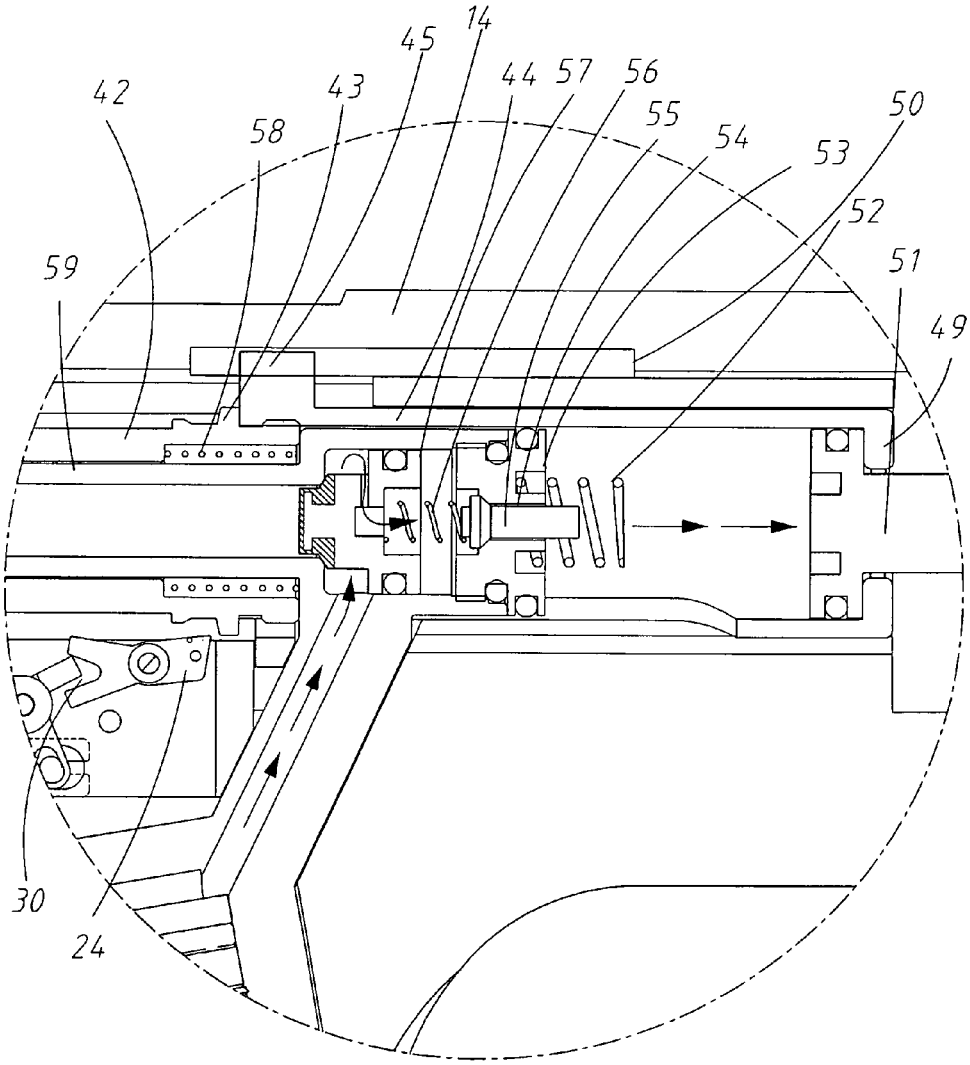
FIG. 9A is a detailed view of the area in circle B of FIG. 9.
Figure 9B:
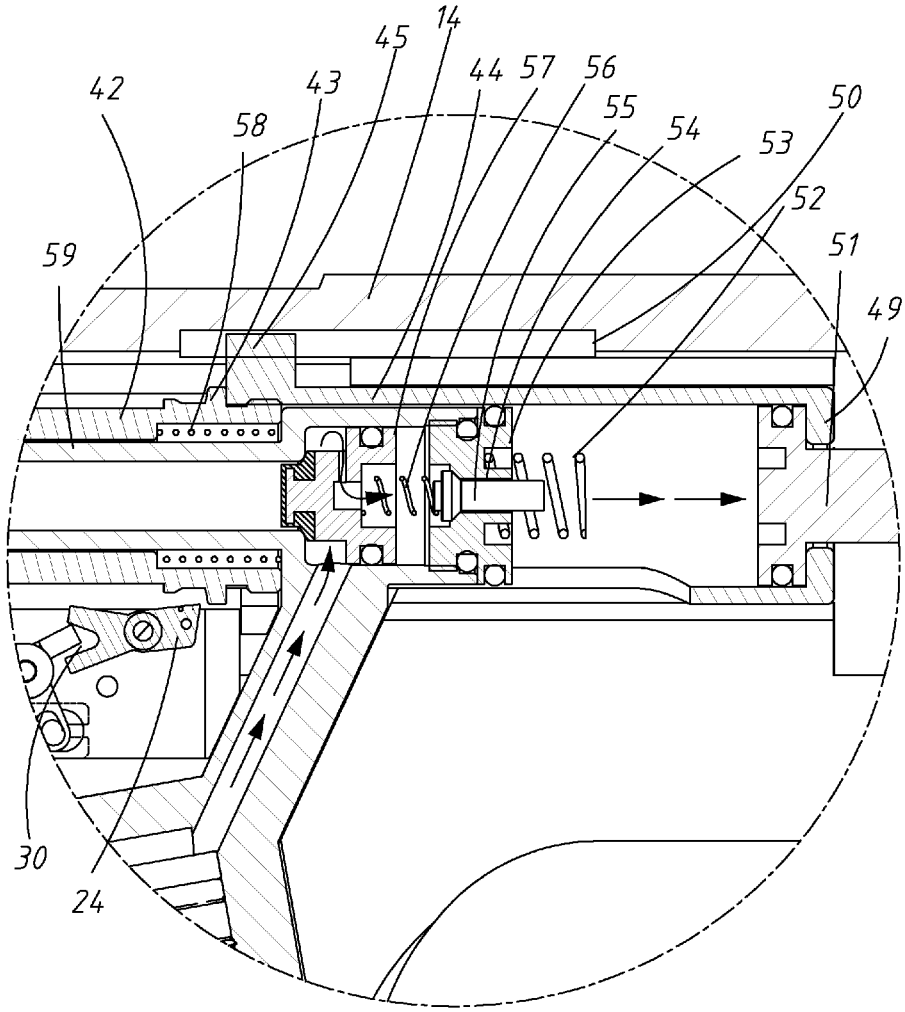

Referring to FIGS. 1 to 9A, a paint ball gun 1 in accordance with the invention comprises the following components as discussed in detail below.

A left half housing 11 and a right half housing 12 provided together form the housing of the paint ball gun 1. A bolt housing 13 is provided on a rear portion of the paint ball gun 1. A pressure vessel 19 with compressed gas such as air or $CO_2$ stored therein is provided in a pistol grip portion of the paint ball gun 1. The pressure vessel 19 is fastened by a fastening member 18. Compressed gas in the pressure vessel 19 is supplied to a hollow enlarged member 59 in the bolt housing 13 via a passage 31. A tube 32 is extended forward of the passage member 59. A passageway 33 is provided in the tube 32 as gas exit route. A hollow enlargement 34 is provided in a rear end of the tube 32. A space 35 is defined by the enlargement 34. Both the tube 32 and the enlargement 34 are in the bolt housing 13. A magazine 17 with a plurality of pellets 10 stored therein is provided forward of the pressure vessel 19 and is also in the pistol grip portion. A switch 20 is provided to allow a pellet 10 to enter a forward portion of the bolt housing 13 or not. The pellet 10 is retained by an arc member 46 in a forward end of the bolt housing 13 in a ready to fire position. A safety 47 is provided besides the arc member 46.

An outer sliding member 14 is provided and extended forward from a front end of the bolt housing 13. A barrel 15 is provided in the outer sliding member 14 and has a rear end in communication with a forward end of the bolt housing 13. A helical spring 16 is put on the barrel 15 and has a forward end anchored at a stop 40 at a forward end of the outer sliding member 14. Thus, the outer sliding member 14 is spring biased member. A rear end of the spring 16 is urged against a tubular member 41.

A trigger 21 is provided downward of the paint ball gun 1. A plate member 22 is provided rearward of the trigger 21 and can be activated by pulling the trigger 21. A pivotal member 23 is provided at a bottom 36 of the bolt housing 13 and can be activated by the plate member 22. The pivotal member 23 is pivotably secured to a rear end of the plate member 22. A receptacle is provided under the pivotal member 23 for anchoring a trigger spring 48 therein. The trigger spring 38 is provided to bias the plate member 22, the pivotal member 23, and the trigger 21 for effecting a trigger operation. The pivotal member 23 is provided in a bifurcation member 28 and is retained and biased by a spring member 25. A retaining member 27 is provided in the bifurcation member 28 to pivotably secure to the pivotal member 23 in cooperation with the spring member 25. An upper portion 37 of the pivotal member 23 is retained in a forward recess 30 of a rocking member 24. A rear end 39 of the rocking member 24 is retained by a retaining ring 43 of an inner sliding assembly 4. A compression spring 58 is put on the tube 32 and has a forward end urged against a first sleeve 42 and a rear end urged against a joining shoulder portion of the tube 32 and the enlargement 34. A helical spring 26 is provided to the rocking member 24 so that the rocking member 24 may pivot elastically.

The inner sliding assembly 4 further comprises a second sleeve 44 threadedly secured to a rear end of the first sleeve 42. The retaining ring 43 is provided on the first sleeve 42 at a joining portion of the first sleeve 42 and the second sleeve 44. An inward extending rim 49 is provided on a rear end of the second sleeve 44. A plunger 51 is provided in the second sleeve 44 and projects rearward out of a central hole of the rim 49. The plunger 51 has a disk shaped head 38 adapted to engage with the rim 49 and stop thereat by moving. An O-ring is put on an annular groove on the head 38 for preventing fluid (e.g., gas) from flowing through an annular gap between the head 38 and the second sleeve 44. A first piston 57 is provided in the enlargement 34 at a stepped-diameter shaped joining portion of the tube 32 and the enlargement 34. A sealing ring 29 is provided on a forward portion of the first piston 57 for blocking gas flow from the passage 31 to the passageway 33. An O-ring is put on the first piston 57 for sealing purpose. A second piston 53 is provided rearward of the first piston 57 and is at a stepped-diameter shaped joining portion of the second sleeve 44 and the enlargement 34. The second piston 53 is spaced from the first piston 57 so that a compression spring 56 may be disposed therebetween. The second piston 53 has a central channel 54. A piston member 55 is provided in the channel 54 and has a forward end disposed in the spring 56 so as to be configured as a spring biased member. A number of O-rings are provided on the second piston 53 for sealing purpose. A helical spring 52 has a forward end anchored on a rear end of the second piston 53. Also, a portion of the piston member 55 is adapted to dispose in the spring 52. A rear end of the spring 52 is adapted to engage with a forward surface of the head 38 as the second piston 53 moves. An annular groove 50 is defined between the outer sliding member 14 and the second sleeve 44. A projection 45 is provided on an outer surface of a forward end of the second sleeve 44 and disposed in the groove 50. The provision of the projection 45 can limit the movement of the second sleeve 44 in a range by contacting two spaced components in the paint ball gun 1.

An operation of the invention will be described in detail below. First, turn the switch 20 to an off position. Press the trigger 21 to pivot the rocking member 24 so as to move rearward the inner sliding assembly 4. And in turn, the safety 47 is off and the arc member 46 is unblocked. Thus, a topmost pellet 10 is pushed upward by a spring disposed on a bottom of the magazine 17. Also, a blocked path from the passage 31 to the passageway 33 is open. Then pressurized gas (e.g., air or $CO_2$) is supplied from the pressure vessel 19 to the tube 32 via the path. And in turn, the first piston 57 moves rearward to compress the spring 56 and also pushes the second piston 53 rearward. Further, the spring 52 pushes the plunger 51 rearward until the plunger 51 is stopped by an internal structure in a rear end of the paint ball gun 1. The compressed gas may push the pellet 10 forward through the barrel 15, i.e., being fired. This paint ball gun 1 is fully automatic so that a continuous firing as quickly as the gun 1 is capable of with a single depression of the trigger 21. The above components will return to its inoperative positions after releasing the trigger 21.

While the invention has been described in terms of preferred embodiments, those skilled in the art will recognize that the invention can be practiced with modifications within the spirit and scope of the appended claims.

What is claimed is:

1. A device for controlling the firing of a paint ball gun comprising:

a pressure vessel with compressed gas stored therein;

a magazine for storing a plurality of pellets and disposed forward of the pressure vessel;

a trigger disposed forward of the magazine;

a plate member disposed rearward of the trigger and activated by pulling the trigger;

a pivotal member disposed at a bottom of the bolt housing and pivotably secured to the plate member;

a bifurcation member for receipt of the pivotal member;

a retaining member disposed in the bifurcation member;

a rocking member for retaining the pivotal member;

a bolt housing comprising a passage member communicating with the pressure vessel, a tube extending forward of the passage member, a hollow enlargement at a rear end of the tube, a switch disposed to allow a topmost one of the pellets to enter the bolt housing or not, an arc member for retaining the pellet, and a safety disposed adjacent to the arc member;

a spring biased outer sliding member disposed forward of the bolt housing;

a barrel disposed in the outer sliding member and having a rear end in communication with the bolt housing;

an inner sliding assembly comprising a spring biased first sleeve, a second sleeve secured to the first sleeve and including a projection on an outer surface, a retaining ring disposed on the first sleeve at a joining portion of the first sleeve and the second sleeve, and an inward extending rim on a rear end of the second sleeve;

a plunger disposed in the second sleeve and projecting rearward out of the inward extending rim, the plunger being defined to move in the second sleeve by the inward extending rim;

a first piston disposed in the passage member, the first piston being disposed in a first position to block a flow path in the passage member when the trigger is not depressed;

a second piston disposed in a joining portion of the second sleeve and the passage member;

a first biasing member disposed between the first piston and the second piston;

a piston member disposed through the second piston and biased by the first biasing member; and a second biasing member having a forward end anchored on a rear end of the second piston and a rear end adapted to engage with the plunger;

wherein in response to turning off the switch and pressing the trigger the inner sliding assembly moves rearward to move the first piston, the second piston, and the plunger rearward until being stopped and disable both the safety and the arc member, and the blocked flow path is open to supply compressed gas from the pressure vessel to the passage member for pushing the topmost pellet through the barrel.

* * * * *